US006219902B1

(12) United States Patent
Memmen et al.

(10) Patent No.: US 6,219,902 B1
(45) Date of Patent: Apr. 24, 2001

(54) METHOD FOR MANUFACTURING A PROTECTIVELY COATED HELICALLY WOUND ANTENNA

(75) Inventors: Stephan D. Memmen, Lincolnshire; Douglas Schneiderman, Hainesville, both of IL (US)

(73) Assignee: T & M Antennas, Vernon Hills, IL (US)

( * ) Notice: Subject to any disclaimer, the term of this patent is extended or adjusted under 35 U.S.C. 154(b) by 0 days.

(21) Appl. No.: 09/217,424

(22) Filed: Dec. 21, 1998

(51) Int. Cl.[7] ..... H01P 11/00

(52) U.S. Cl. ..... 29/600; 264/272.15; 264/272.19; 343/895

(58) Field of Search ..... 29/600, 601, 605; 264/272.19, 272.15; 343/895

(56) References Cited

U.S. PATENT DOCUMENTS

| | | | |
|---|---|---|---|
| 3,774,221 | | 11/1973 | Francis . |
| 3,828,353 | | 8/1974 | Majkrzak et al. . |
| 3,902,178 | | 8/1975 | Majkrzak . |
| 4,097,867 | | 6/1978 | Eroncig . |
| 4,435,713 | | 3/1984 | Gasparaitis et al. . |
| 4,435,716 | | 3/1984 | Zandbergen . |
| 4,914,450 | | 4/1990 | Dilley et al. . |
| 5,057,849 | | 10/1991 | Dörrie et al. . |
| 5,226,221 | * | 7/1993 | Kilgore ..... 29/605 |
| 5,341,149 | | 8/1994 | Valimaa et al. . |
| 5,648,788 | | 7/1997 | Bumsted . |
| 5,650,789 | | 7/1997 | Elliott et al. . |
| 5,661,495 | | 8/1997 | Saldell . |
| 5,686,927 | | 11/1997 | Simmons . |
| 5,836,072 | * | 11/1998 | Sullivan et al. ..... 29/600 |

* cited by examiner

*Primary Examiner*—Stephen F. Gerrity
*Assistant Examiner*—Rhonda E Sands
(74) *Attorney, Agent, or Firm*—Greer, Burns & Crain, Ltd.

(57) ABSTRACT

An efficient and repeatable method for manufacturing a protectively coated helical conductor antenna. The helical conductor is threaded onto a temporary, removable support, such as a bolt including a shaped head and a shank having threads to hold the helical conductor. After being threaded on the bolt, the entire winding and the bolt shank are placed within an injection mold cavity. The mold also includes a recess outside of the injection cavity for accommodating the bolt head, with the recess being shaped to permit a specific orientation for the bolt. The shape of the bolt head and the recess define a repeatable orientation for the bolt and helical conductor. As a result, the point of injection relative to the helical winding may be exactly repeated time and time again. This allows selection of an injection point relative to the helical winding that produces minimal deformation, and the obtainment of consistent results thereby reducing variation and necessary manufacturing tolerances.

12 Claims, 3 Drawing Sheets

METHOD FOR MANUFACTURING A PROTECTIVELY COATED HELICALLY WOUND ANTENNA

The present invention generally concerns a method for manufacturing a protectively coated helically wound antenna, such as those typically used in portable communication devices. More specifically, the present invention concerns a method for manufacturing a helically wound antenna which forms the protective coating using injection molding, but avoids deformation of the helical winding during molding by precise and repeatable control of the molding point relative to the winding.

BACKGROUND OF THE INVENTION

Portable communicators, such as cell phones, frequently utilize antennas including a helical winding. Helical windings permit a relatively long effective antenna length with a small physical antenna length. This is convenient in cell phones and other portable communicators since small physical size is beneficial and since a certain antenna length is necessary to achieve particular broadcast and reception frequencies. Accordingly, antennas are frequently formed, in whole or part, from a helical conductor. Small size also dictates that the wire used to form the helical conductor be thin. This requires the helical conductor to be encased in a protective material, since cell phone antennas are often subjected to forces which would permanently deform delicate helical windings.

The typical helical windings are formed from a thin and delicate conductive wire. Thin wires help preserve the desired small size and low weight which is desirable in portable communicators. Thin conductive wires also facilitate the low power transmission and reception functions of portable communicators.

The coating of such thin helical conductors with protective material has proved difficult. Injection molding is an efficient and widely used coating technique, but often deforms delicate helical antenna conductors. The helical winding is placed in a mold, typically while it is mounted on a core, and thermoplastic material is injected into the mold. Significant forces are applied to the helical winding during the injection, and deform the winding by changing its pitch, i.e., the spacing between windings, and causing the pitch to be nonuniform. This changes the electrical characteristics of the antenna in a manner which may vary from one antenna to the next during manufacturing. Compensation for these variances is often achieved through additional processing, such as testing and trimming to tune the antenna to a desired frequency. Even still, a significant percentage of manufactured antennas may be unsuitable for use. Obviously, this increases both the cost and difficulty of manufacturing. In addition, performance tolerances must be generous enough to accommodate the variances experienced in those antennas which are still suitable for use.

It is known to wind the helical structure around supports prior to injection to attempt to avoid deformation. Exemplary techniques are disclosed in Bumsted, U.S. Pat. No. 5,648,788, Jul. 15, 1997, and in Valimaa et al., U.S. Pat. No. 5,341,149, Aug. 23, 1994. In the first technique, a relatively complex molding process is disclosed, where a sliding bar locks a coil onto a special handle assembly for molding. The mold includes mold pads for holding the coils in place during molding. This leaves portions of the coils exposed, requiring additional processing.

Valimaa also recognizes the potential for thin helical windings to deform during injection molding, and discloses a threaded support core, used for molding of helical coils. The core is completely molded into the coil and therefore cannot control the point of injection relative to the beginning of the winding. Neither Bumsted or Valimaa recognizes or addresses the need to control this point to avoid deformation in the first few windings.

In sum, there is a need for an improved and efficient method of manufacturing a protectively coated helically wound antenna which addresses shortcomings of prior techniques. In addition, there is a need for an improved and efficient method for manufacturing such an antenna which produces a repeatable consistent helical structure, avoids deformation throughout the winding, and avoids significant post-processing trimming and tuning.

SUMMARY OF THE INVENTION

The present method is an improved, efficient and repeatable method for manufacturing a protectively coated helical conductor antenna. The helical conductor is threaded onto a temporary, removable support, such as a bolt including an asymmetrically shaped head and a shank having threads to hold the helical conductor. After being threaded on the shank, the entire winding and the associated portion of the bolt shank are placed within an injection mold cavity. The mold also preferably includes a recess outside of the injection cavity for accommodating the bolt head, with the recess being shaped to permit a specific orientation for the bolt. The shape of the bolt head and the recess define a repeatable orientation for the bolt and helical conductor. As a result, the point of injection relative to the helical winding may be exactly repeated time and time again. This allows selection of an injection point relative to the helical winding that produces minimal deformation, and the obtainment of consistent results thereby reducing variation and necessary manufacturing tolerances A preferred application of the present method is manufacture of an antenna having an elongated conductor, with a helical conductor attached at an end of the elongated conductor. The helical conductor and elongated conductor are joined by an electrode. A shank end of the bolt mates with the electrode and presses against the beginning of the helical winding. The shaped head of the bolt orients the beginning of the helical winding, which is locked between the electrode and shank, adjacent the thermoplastic injection point. Pressing of the bolt at this point prevents deformation of the helical winding at the point where the force created by thermoplastic injection is most powerful, while the shank threads oppose deformation of the helical winding throughout its remainder.

After injection, the mold is opened, and the bolt and antenna are removed. Because the head was kept outside of the injection cavity, the bolt is conveniently removed by unthreading. An opening left where the bolt was removed may be capped. A core may be inserted in the space occupied by the shank during the injection molding. Alternatively or additionally, center fill molding may be used to finish the open end.

BRIEF DESCRIPTION OF THE DRAWINGS

Other features and advantages of the invention will be apparent to those skilled in the art with reference to the detailed description and the drawings, of which.

DETAILED DESCRIPTION OF THE INVENTION

Broadly stated, the present method provides for repeatable and precise control of an injection point for injecting thermoplastic material around a delicate helical conductor in a repeatable and precisely controlled fashion. Helical windings molded according to the method of the invention are uniform and avoid the need for tuning and trimming that is inherent in many conventional techniques used to mold helical windings.

Figure 1A:
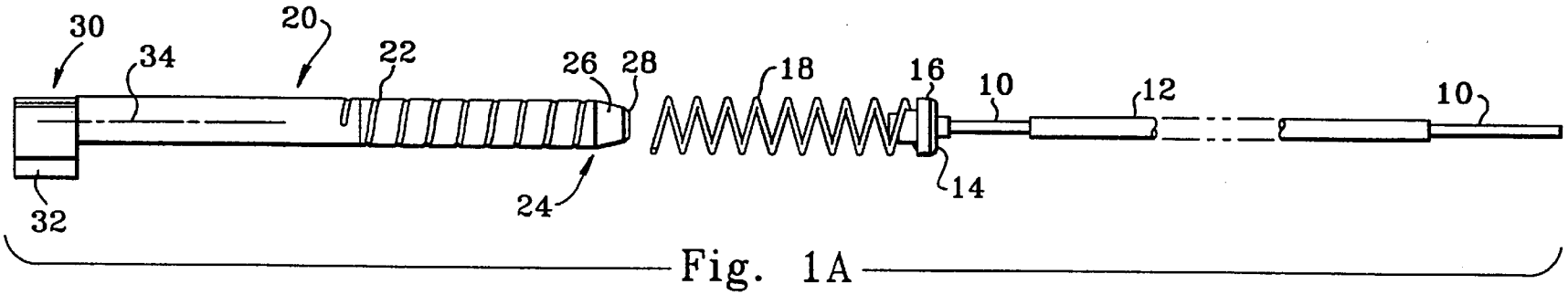
FIG. 1A shows a bolt and helical conductor assembly used in the method of the present invention.

Referring now to the drawings and particularly to FIG. 1A, shown is a bolt and helical conductor 18 winding preliminary assembly which is of critical importance to the method of the invention. While the method of the invention is applicable to molding of any helical conductor 18 structure antenna to an appropriate electrode, the method is illustrated with respect to a preferred dual conductor cell phone antenna. Specifically, the antenna includes an elongated conductor 10 having an insulating protective sleeve 12 around it, from which the elongated conductor 10 extends out of either end for electrical contact with remaining parts of the antenna and/or phone circuits to which the antenna is applied. At one end, the elongated conductor 10 is attached, preferably through crimping, to an electrode 14. The electrode 14 is preferably crimped to the elongated conductor 10 on both sides of its cup 16, which is used to accommodate a helical conductor 18 having a predetermined desirable length and pitch. It is important that the elongated conductor 10 not protrude from the end of the cup 16 which is on the side of the helical conductor 18. The end of the elongated conductor 10 may exist anywhere within the cup 16, but may not extend out the other end therefrom.

The cup 16 includes a concave recess on the side facing the helical conductor 18 to accommodate an end of the helical conductor which lays flat within the cup 16. The cup 16 is crimped to the end of the helical conductor 18 which is accommodated therein. FIG. 1B shows a preferred cup electrode 16 including a rim extension 17 that is conveniently crimpable over the end of the helical conductor. After this connection of the elongated conductor 10 to the electrode 14 and the helical conductor 18, a temporary bolt 20 is threaded into the helical conductor 18. The bolt 20 includes threads which are numbered and pitched to accommodate the predetermined desirable number and pitch of threads on the helical conductor 18. A tapered end 24 of the bolt 20 includes multiple generally convex surfaces 26 and 28 which serve to hold the bottom of the helical conductor 18 firmly against the electrode cup 16 when the bolt is threaded completely into the helical conductor 18. An opposite end of the bolt includes a shaped head 30. According to the invention, at least a portion of the shaped head must be asymmetrical so that it uniquely fits into an appropriately accommodating injection mold.

Figure 1C:
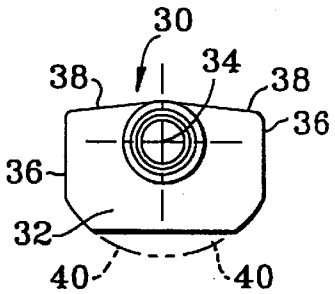
FIG. 1C shows a top view of the bolt of FIG. 1A.
Figure 1B:
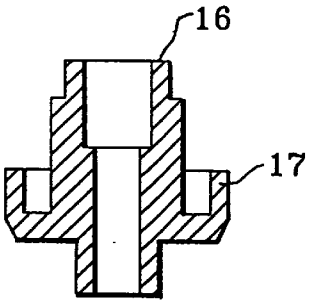
FIG. 1B shows a preferred electrode for mounting a helical conductor in the method of the invention.

A preferred asymmetrical shape is illustrated in FIGS. 1A and 1C wherein an extension 32 extends from a single side of the bolt head 30. As is best seen from the top view of FIG. 1C, the head 30 including the extension 32, includes an asymmetrical shape about an elongate axis 34 of the bolt 20. A preferred shape for the head 30 includes respective matching straight 36, angled 38, and curved 40 surfaces which serve to uniquely orient the head 30 and the entire bolt 20 along the bolt's elongate axis 34 when placed in a mold shaped according to the principles of the present invention.

Figure 2:
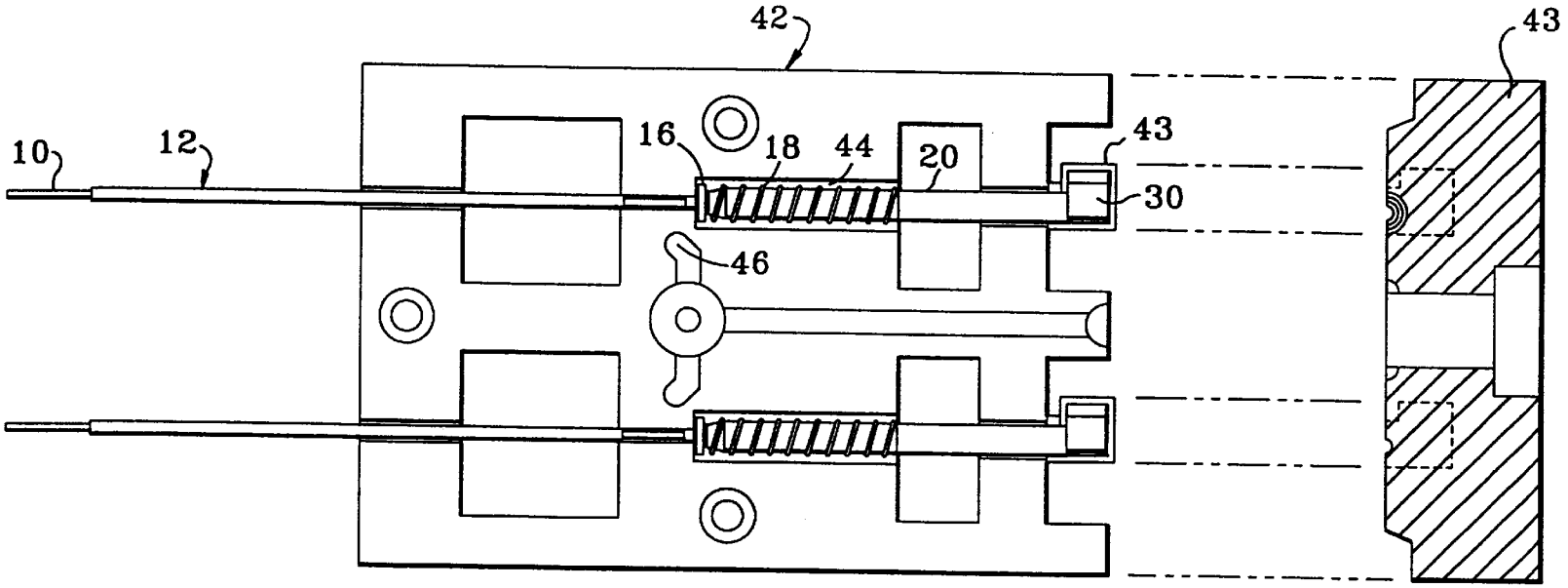
FIG. 2 shows a mold used in the method of the invention.

Referring now to FIG. 2, the next step of the method of the invention is illustrated with respect to a preferred mold 42 which accommodates two antennas for molding. Half of the mold is shown in FIG. 2, with the other half being of corresponding shape. The mold 42 accommodates a portion of the bolt including the helical winding 18 in an injection molding cavity 44 which is fed by an injection molding point 46. An end portion of the mold 42 extends to include a recess for uniquely orienting the asymmetrical bolt head 30. Alternatively, a separate structure which cooperates with the mold 42 may be used for this purpose. In FIG. 2, portion 43 of the mold includes portions to uniquely orient the bolt head 30. Thus, as will be appreciated by artisans, the bolt temporarily threaded into the helical conductor 18 will uniquely and repeatedly orient the helical conductor 18 within the injection mold 42. This unique orientation preferably orients the injection point to be at the lowest part of the helical conductor 18 that contacts the cup 16, thus placing the first winding which is not held between surfaces of the end of the bolt 20 and the cup 16 furthest away from the injection point 46. It has been found that a preferred angle between the elongate axis 34 of the bolt be 35° to the angle of injection of thermoplastic material into the cavity 44. This minimizes deformation of the helical conductor 18.

Once the subassembly including the helical conductor 18 is placed within the mold, the mold is sealed and thermoplastic material is injected into the cavity 44 via conventional techniques. It is preferred that the thermoplastic material include a lubricant.

Figure 3A:
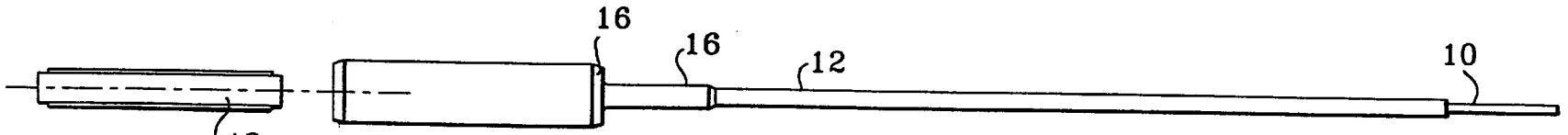
FIGS. 3A–3B illustrate preferred finishing steps in the method of the invention.
Figure 3B:
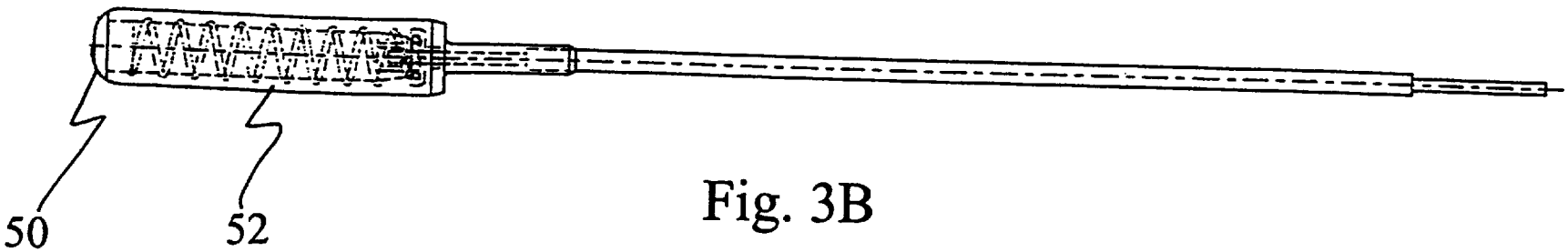

After molding around the helical conductor 18 has been completed, the mold is opened and the structure is removed. The bolt 20 is unthreaded from the now coated helical conductor 18. From here, an additional step to finish the thermal plastic coating of the helical conductor 18 is conducted. This may comprise simply an additional molding step in which material is injected to the inside, but it is preferred that a core plug 48 is inserted prior to the finish mold, as seen in FIG. 3A. This nonconductive plug 48 will be permanently molded into the helical conductor 18 structure, and protects the helical conductor 18 as center filling molds a cap 50, seen in FIG. 3B, which bonds to the remaining thermoplastic material 52. The removed bolt 20 is suitable for additional moldings.

Artisans will appreciate the repeatable nature of control the molding point according to the invention. Artisans will also appreciate that many antenna structures incorporating a helical conductor may be produced according to the method of the invention. These and many other variations will be apparent to artisans within the scope of the invention.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. A method for manufacturing a protectively coated antenna including a helical conductor, the method comprising the steps of:

threading a temporary support into the helical conductor with the helical conductor engaging threads on the temporary support, the temporary support including an asymmetrically shaped head;

placing the helical conductor, while it is engaged with the temporary support, into an injection mold including an injection molding cavity, the injection mold including a recess outside of the molding cavity for accommodating the shaped head, the recess being shaped to orient the temporary support so that thermoplastic material is injected at a predetermined repeatable point with respect to the helical conductor;

injecting thermoplastic material into the molding cavity;

removing the helical conductor from the molding cavity; and unthreading the temporary support from the helical conductor.

2. The method according to claim 1, wherein the predetermined point is aligned below a beginning point of the helical conductor.

3. A method for manufacturing a protectively coated antenna including a helical conductor, the method comprising the steps of:

mounting an end of the helical conductor to an electrode;

threading a temporary support into the helical conductor with the helical conductor engaging threads on the support, the temporary support mating with the electrode to lock a portion of the helical conductor between the electrode and the temporary support;

placing the helical conductor, while it is engaged with the temporary support, into an injection mold including an injection molding cavity;

injecting thermoplastic material into the injection molding cavity;

removing the helical conductor from the injection molding cavity; and unthreading the temporary support from the helical conductor.

4. The method according to claim 3, wherein a portion of the temporary support is accommodated within the injection mold outside of the injection molding cavity.

5. The method according to claim 4, wherein the portion of the temporary support comprises a head.

6. The method according to claim 5, wherein the head and mold are asymmetrically shaped to orient the temporary support so that said thermoplastic material is injected at a predetermined repeatable point with respect to the helical conductor.

7. The method according to claim 3, further comprising the step of finishing an end of the helical conductor after said step of unthreading.

8. The method according to claim 4, wherein said step of finishing comprises capping the end of the helical conductor.

9. The method according to claim 7, wherein said step of finishing includes insertion of a core into the helical conductor and sealing the end of the helical conductor after insertion of the core.

10. The method according to claim 3, wherein the thermoplastic material is injected into the molding cavity adjacent the electrode.

11. The method according to claim 3, wherein the temporary support includes a generally convex end which mates with a concave surface of the electrode to lock a portion of the helical conductor between the temporary support and the electrode.

12. The method according to claim 3, wherein said step of mounting comprises crimping and said electrode forms a generally cup shaped receptacle for accepting the end of the helical conductor including an extended rim which is crimped over the end of the helical conductor.

* * * * *